US005861797A

United States Patent [19]

Becker

[11] Patent Number: 5,861,797

[45] Date of Patent: Jan. 19, 1999

[54] TACTILE REMINDER DEVICE & METHOD

[76] Inventor: Laurence D. Becker, 705 W. La Veta Suite 214, Orange, Calif. 92668-4483

[21] Appl. No.: 897,242

[22] Filed: Jul. 18, 1997

[51] Int. Cl.[6] ..... G08B 1/00

[52] U.S. Cl. ..... 340/309.3; 340/309.4; 340/407.1; 340/573; 368/41; 368/73; 368/230; 368/281

[58] Field of Search ..... 368/41, 43, 72, 368/73, 74, 230, 250, 251, 281; 340/309.15, 309.3, 309.4, 573, 575, 576, 407.1, 407.2

[56] References Cited

U.S. PATENT DOCUMENTS

| | | | |
|---|---|---|---|
| 4,362,392 | 12/1982 | Kumata | 368/41 |
| 4,456,387 | 6/1984 | Kazunobu | 368/230 |
| 5,023,853 | 6/1991 | Kawata et al. | 368/230 |
| 5,282,181 | 1/1994 | Entner et al. | 340/407.1 |
| 5,285,430 | 2/1994 | Decker | 368/281 |
| 5,444,671 | 8/1995 | Tschannen et al. | 340/825.44 |
| 5,444,673 | 8/1995 | Mathurin | 368/63 |

*Primary Examiner*—Daniel J. Wu

*Attorney, Agent, or Firm*—Connors & Associates; John J. Connors

[57] ABSTRACT

A reminder device includes a case sized so that said case is adapted to be worn on the wrist of a user. The case holds a microprocessor, a tactile alarm, an electric clock, and a battery which provides electric power to the microprocessor, the tactile alarm, and the electric clock. A display on the case displays from time to time (a) a pay attention notice alerting the user to be attentive, and (b) one of a plurality a pre-programmed reminder messages. A control panel enables the user to select a periodic interval at which the pay attention notice is displayed, the desired pre-programmed reminder message displayed, and the day and time at which the pre-programmed reminder message is displayed. The alarm is activated when the pay attention notice is displayed and when the pre-programmed reminder message is displayed.

14 Claims, 13 Drawing Sheets

Detailed Block Diagram

PROGRAMMING FLOW CHART

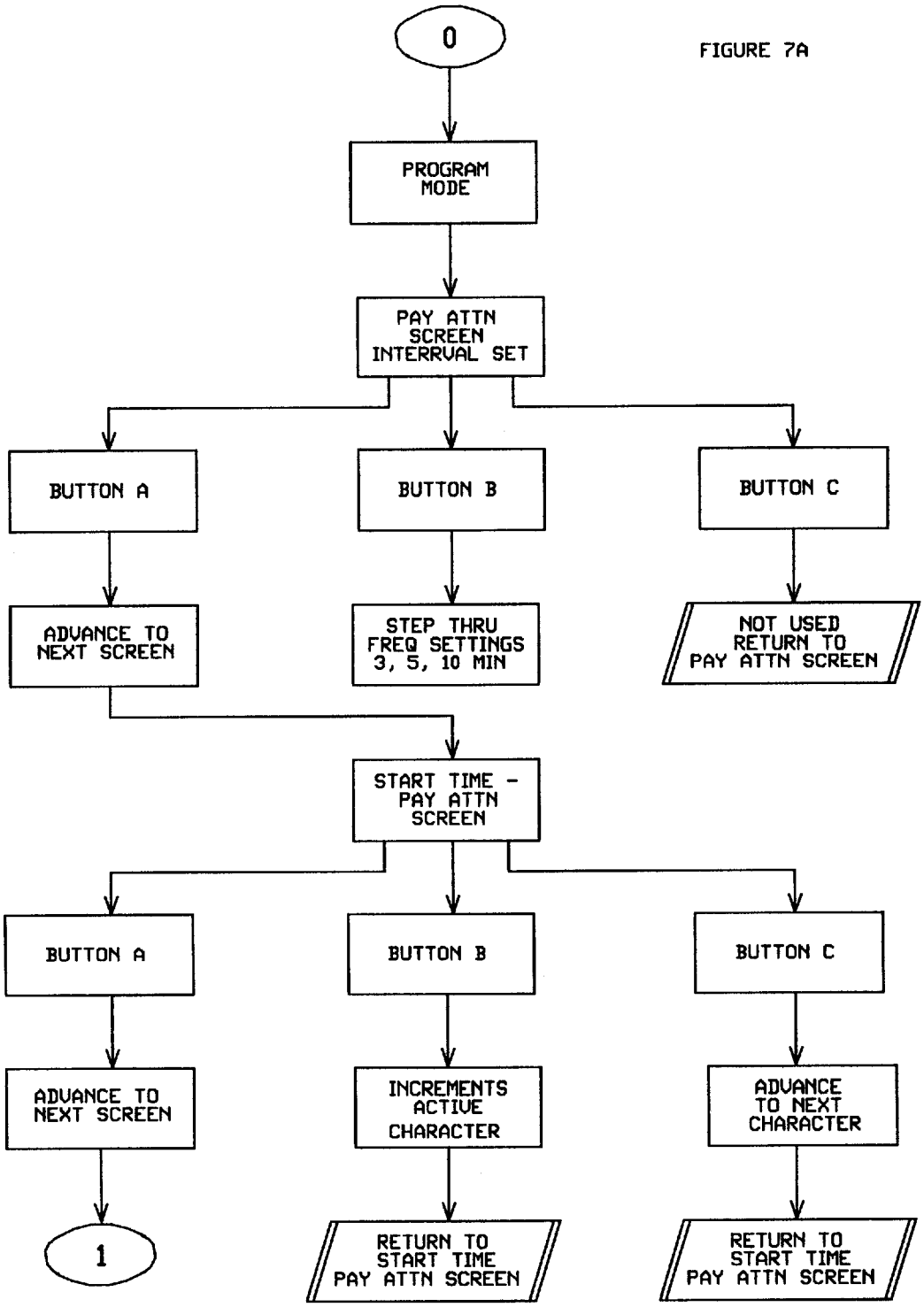
PROGRAMMING FLOW CHART

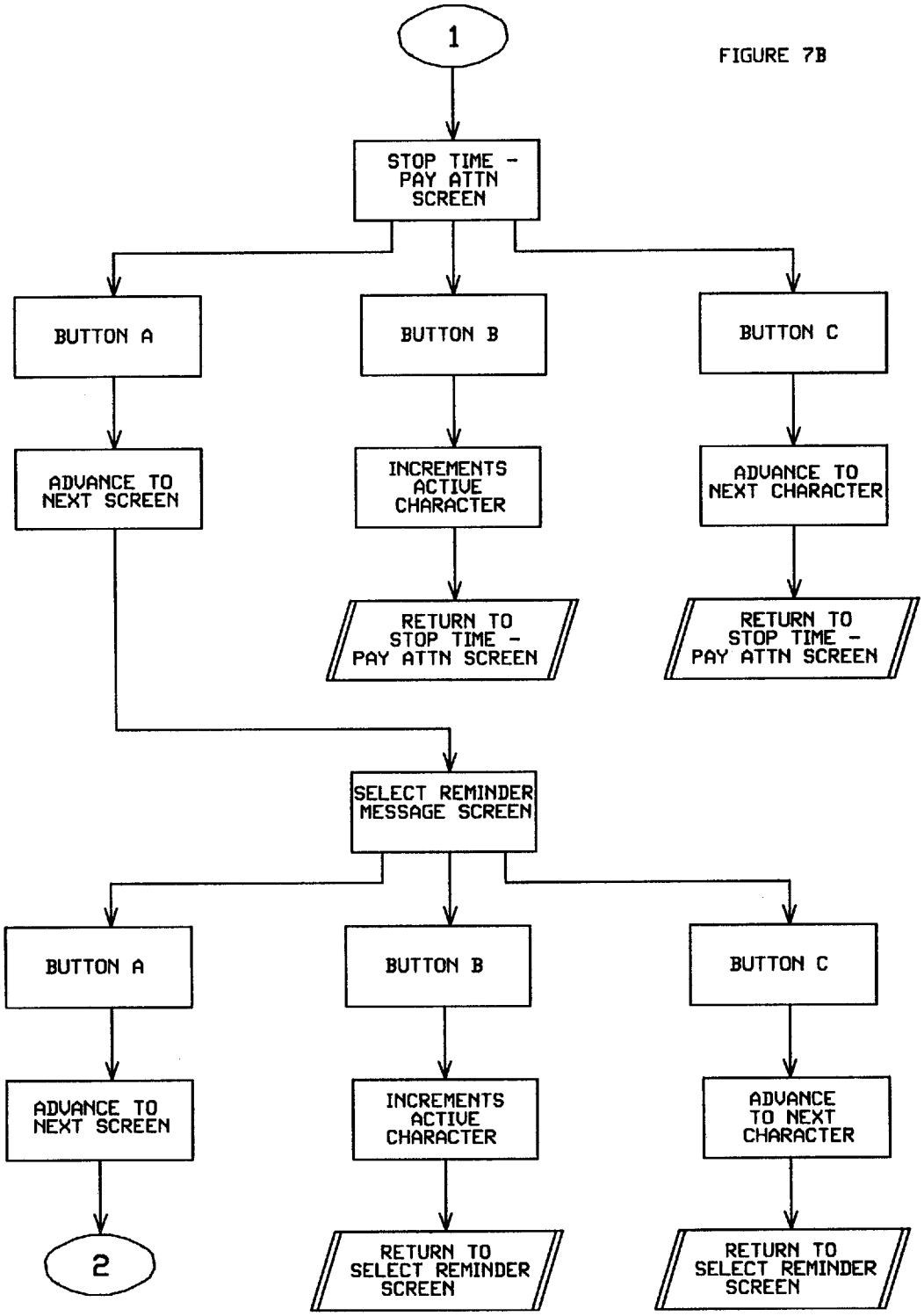
PROGRAMMING FLOW CHART

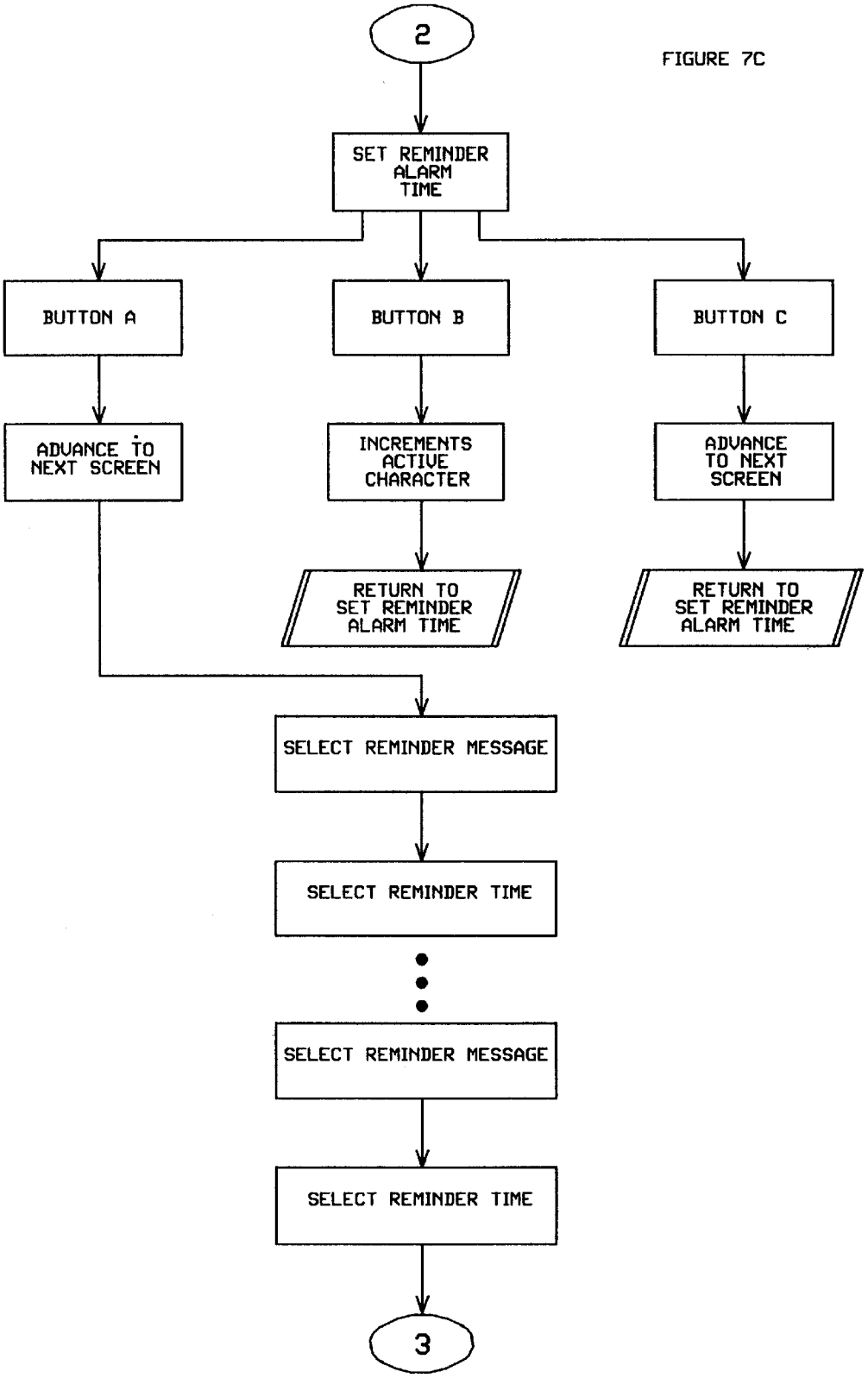
PROGRAMMING FLOW CHART

PROGRAMMING FLOW CHART

PROGRAMMING FLOW CHART

TACTILE REMINDER DEVICE & METHOD

BACKGROUND OF THE INVENTION

1. Field of the Invention

This invention relates to electronic reminder devices used by individuals with Attention Deficit Hyperactivity Disorder (ADHD) and related difficulties.

2. Background Discussion

There are approximately ten million adults and children in the United States with Attention Deficit Hyperactivity Disorder (ADHD). Individuals with this disorder suffer from a short attention span accompanied by distractibility, forgetfulness, hyperactivity, and impulsivity. Many of these individuals take medication for their ADHD and require accommodations at their school or work. Their forgetfulness and lack of attention results in forgetting to take their medication, losing track of their school work, daydreaming, and general inability to stay on task. Parents, spouses, and teachers attempt to remind them of these tasks, but they are unable to do so on a constant basis.

Several devices have been developed to assist children with ADHD. These devices are cumbersome and generally designed to be placed on a student's desk or belt. One of these devices requires intervention by an observer to activate a visible and audible warning, creating almost as much disruption as manual intervention. Another device periodically vibrates as a reminder, but provide no indication of what the reminder is for. These devices are noticeable to others, resulting in a negative social stigma often associated, are disruptive, and have limited effectiveness.

SUMMARY OF THE INVENTION

It is the objective of this invention to provide a reminder device which is reliable and to present to individuals with Attention Deficit Hyperactivity Disorder (ADHD) inconspicuous reminders and messages by means of a periodic tactile alarm (a silent vibration) and notice and message display, all held by a watch-like casing worn on the user's wrist. The unique combination of a chronometer, a periodic visible "pay attention" notice, one or more selected visible messages presented at times selected by the user accompanied by a tactile alarm. Such a reminder device enables an individual with ADHD to achieve independence and maintain normal performance levels in school without the negative social stigma of an obvious, visible remedial device.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT", one will understand how the features of this invention provide its benefits, which include reliability, effectiveness, and inconspicuousness.

The first feature of the reminder device of this invention is that it includes a case sized so that the case is adapted to be worn on the wrist of a user. The case holds a microprocessor, a tactile alarm, an electric clock, and a battery which provides electric power to the microprocessor, the tactile alarm, and the electric clock. All of these components fit within the case, resulting in a device which initially appears to be a simple wristwatch. The tactile alarm has a single fixed vibration mode. This tactile alarm creates a vibratory sensation through the case, on the wrist of the user, when activated by the microprocessor. This sensation alerts the user to read the message on the device, thus reminding the user to pay attention, take medication, or do other scheduled tasks. The silent operation of this alarm assures that privacy and discretion are maintained without detracting in any way from the device's effectiveness.

The second feature is a display on the case which displays from time to time (a) a notice alerting the user to be attentive (Pay Attention Mode), and (b) one of a plurality a pre-programmed messages (Reminder Mode). The pre-programmed message is selected by the user, and a control panel on the case enables the user to select which of the pre-programmed messages is displayed. The panel has several pushbuttons electrically connected to the microprocessor. These pushbuttons are used to set a periodic interval at which the pay attention notice is displayed, a message display, and to reset the tactile alarm. The pushbuttons are also used to set a periodic interval at which the notice is displayed, the message display time and content, and set the time and date of the electric clock.

The third feature is a control mechanism, including the pushbuttons and the microprocessor, which enable the user to switch between an operating mode and a programming mode. In the programming mode, the user selects (a) the periodic interval at which the pay attention notice is displayed, (b) what time period during the course of a day the pay attention notice shall be displayed at the selected periodic interval, (c) the pre-programmed reminder message to be displayed, (d) the day and time at which said selected pre-programmed message is displayed, and. The alarm is activated when the notice is displayed. The alarm is also activated when the pre-programmed message is displayed.

The fourth feature is that the device includes a display or readout which displays data from the microprocessor. The readout displays (a) at periodic intervals selected by the user a notice to pay attention, (b) the pre-programmed reminder message selected by the user, and (c) a time and date. The control mechanism includes (a) a mode control mechanism which enables the user to switch between a programming mode and a operating mode, (b) a change control member which enables the user to change a setting of said reminder message while in said programming mode, and (c) a reset control member which enables the displayed message to be cleared by the user. The display, preferably a liquid crystal display, is capable of displaying any of the pre-programmed reminder messages, as well as standard clock and calendar data. This display is connected to and controlled by the microprocessor, which activates the display at pre-programmed intervals or times as set by the user.

This invention also includes a method of assisting individuals with Attention Deficit Hyperactivity Disorder (ADHD) to pay attention and in remembering their daily tasks. This method includes (a) the individual wearing a watch-like device that (i) operates periodically at a predetermined interval (e. g. 3, 5, or 10 minutes) to display a notice that the individual pay attention, (ii) periodically displays a reminder message selected by said individual, (iii) operates a tactile alarm when the pay attention notice is displayed, and (iv) operates a tactile alarm when the reminder message is displayed, and (b) the individual selecting the interval and the message. The watch-like device comprises the elements discussed above.

DESCRIPTION OF THE DRAWING

The preferred embodiment of this invention, illustrating all its features, will now be discussed in detail. This embodiment depicts the novel and non-obvious tactile reminder device and method of this invention as shown in the accompanying drawing, which is for illustrative purposes only. This drawing includes the following figures (FIGURES), with like numerals indicating like parts:

FIGS. 7A through 7E are program flow charts showing the programming process in the programming mode of the three-button control embodiment of the tactile reminder device of this invention.

DETAILED DESCRIPTION OF THE PREFERRED EMBODIMENT

Figure 1:
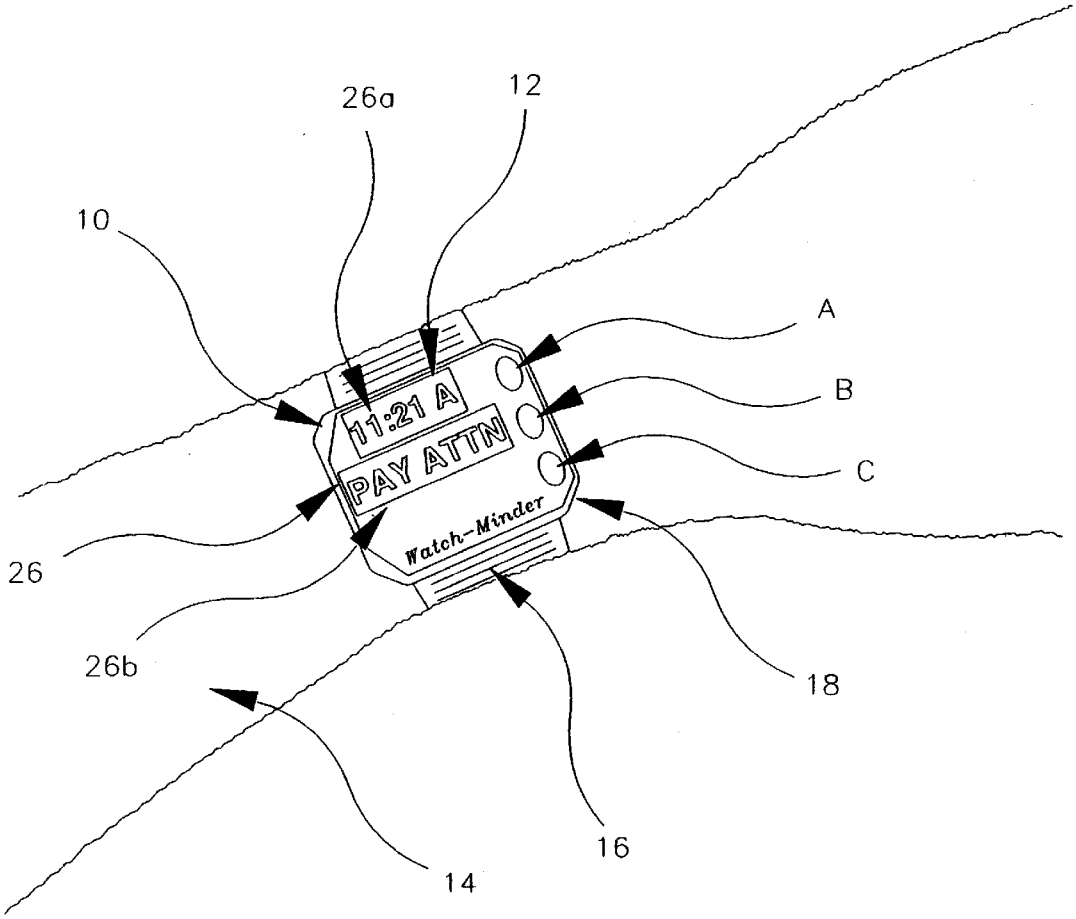
FIG. 1 is a perspective view showing the tactile reminder device of this invention worn by a user.

As depicted in FIGS. 1 through 4, the tactile reminder device 10 of this invention includes a case 12 holding a liquid crystal display 26, a microprocessor 28, a coin type battery 30, a tactile alarm 32, and a clock/calendar chip 34 which provides a chronometer. The display 26 is mounted on the case 12 so as to be easily readable by the user. On the exterior of the case to one side of the display 26 is a control panel 18. The case 12 is worn on the wrist 14 of the user by means of a watchband 16.

Figure 4:
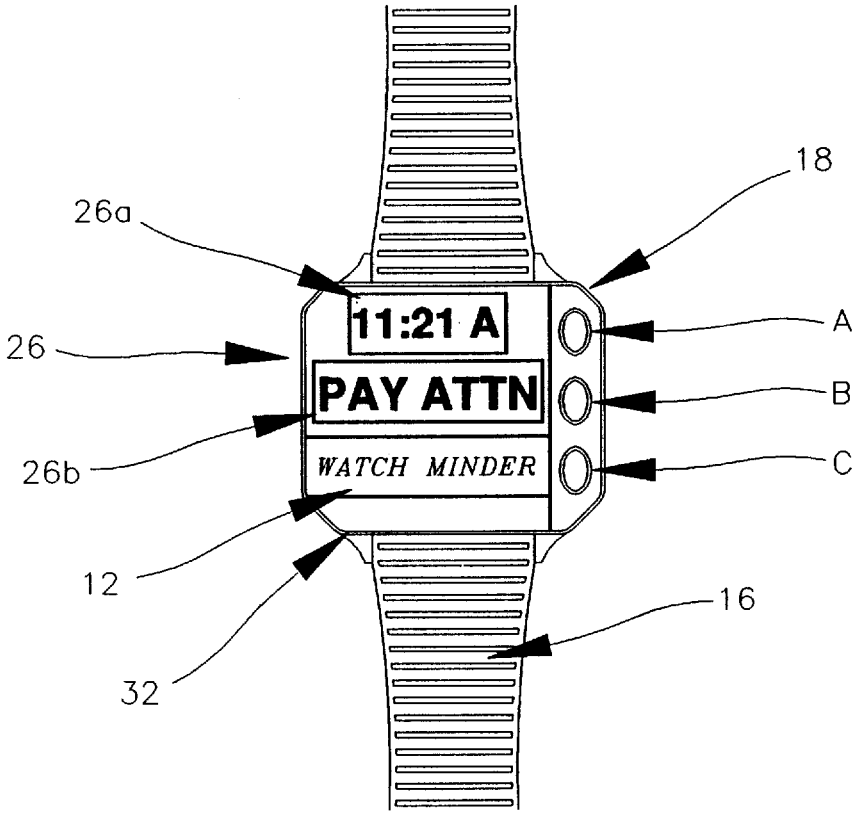
FIG. 4 is an plan view of the tactile reminder device of this invention showing the display and control panel.

As best illustrated in FIG. 4, the control panel 18 comprises three small pushbuttons: A, B, and C. Three pushbuttons are preferred, but more or less could be employed. The pushbutton A is used to switch the reminder device 10 between an operating mode and a programming mode. In the operating mode, the device has a "PAY ATTENTION mode" and a "REMINDER mode". In the PAY ATTENTION mode, a notice is periodically (e. g. 3, 5, or 10 minutes) displayed on the display 26 reminding the user to be attentive. In the REMINDER mode, at pre-set times a selected message is displayed on the display 26, typically informing the user of some task to be performed. The alarm 32 is activated when either the notice or the message is displayed. In the programming mode, the users selects the frequency of the notice, the type of message to be displayed, and the day and time of the message. The pushbuttons B and C have multiple functions dependant on which mode the tactile reminder device 10 is in. These will be fully described below.

The liquid crystal display 26 includes the display panels 26*a* and 26*b*. The display panel 26*a* switches between a time mode and a date mode, and the display panel 26b switches between a pay attention mode and a reminder message mode as selected by the user. At the time and day selected by the user, the pre-programmed message selected by the user is displayed and the silent alarm is activated. For example, the display panel 26*b* will at 10:00 AM, Dec. 25, 1996, the time and day selected by the user, shows the characters "TAKE MED", an abbreviation for "take medication". After a predetermined time has elapsed, the display panel 26*b* automatically switches back to the reminder mode. The display panel 26*b* displays at a selected time interval or frequency selected by the user the pay attention notice (PAY ATTN) reminding the user to be attentive. Simultaneously, the alarm 32 is activated. During a selected period over the course of a day, the pay attention notice is displayed at the selected frequency and the alarm activated. For example, the display panel 26*b* may show every 3, 5, or 10 minutes between 9:00 AM and 3:00 PM as selected by the user the characters "PAY ATTN", an abbreviation for "pay attention".

Figure 2:
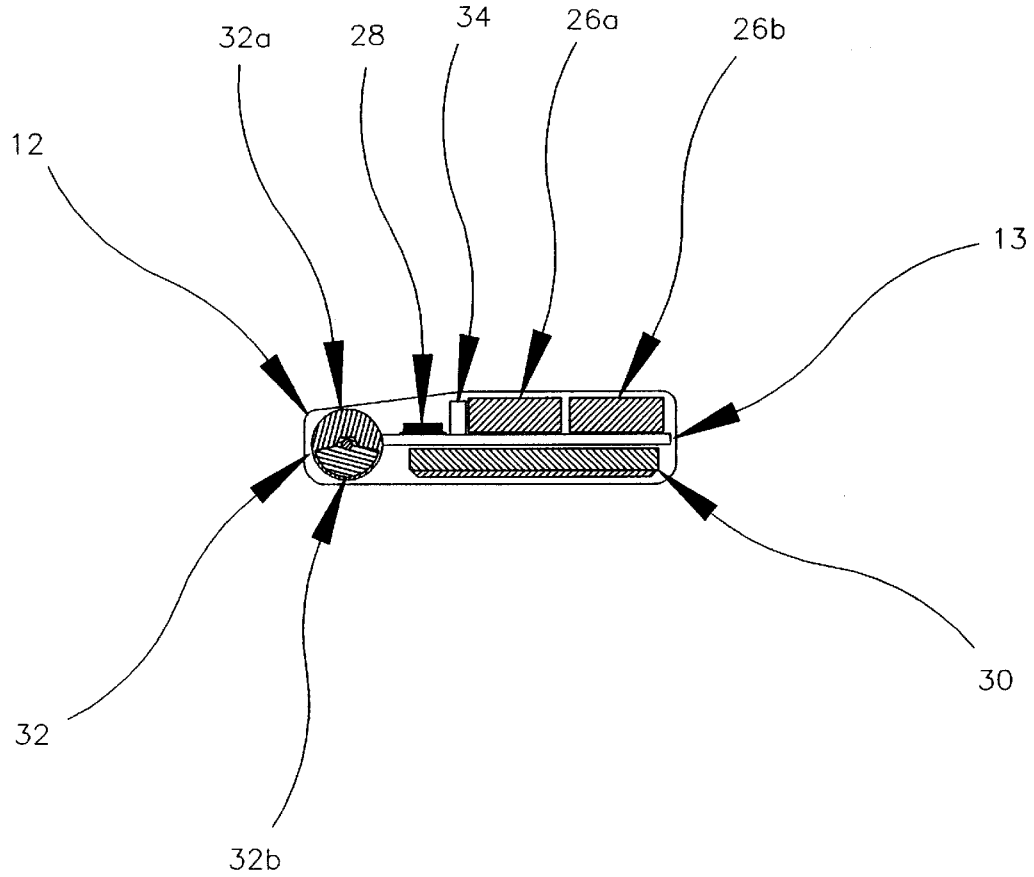
FIG. 2 is an cross-sectional view showing the case holding the principal components of this invention.
Figure 3:
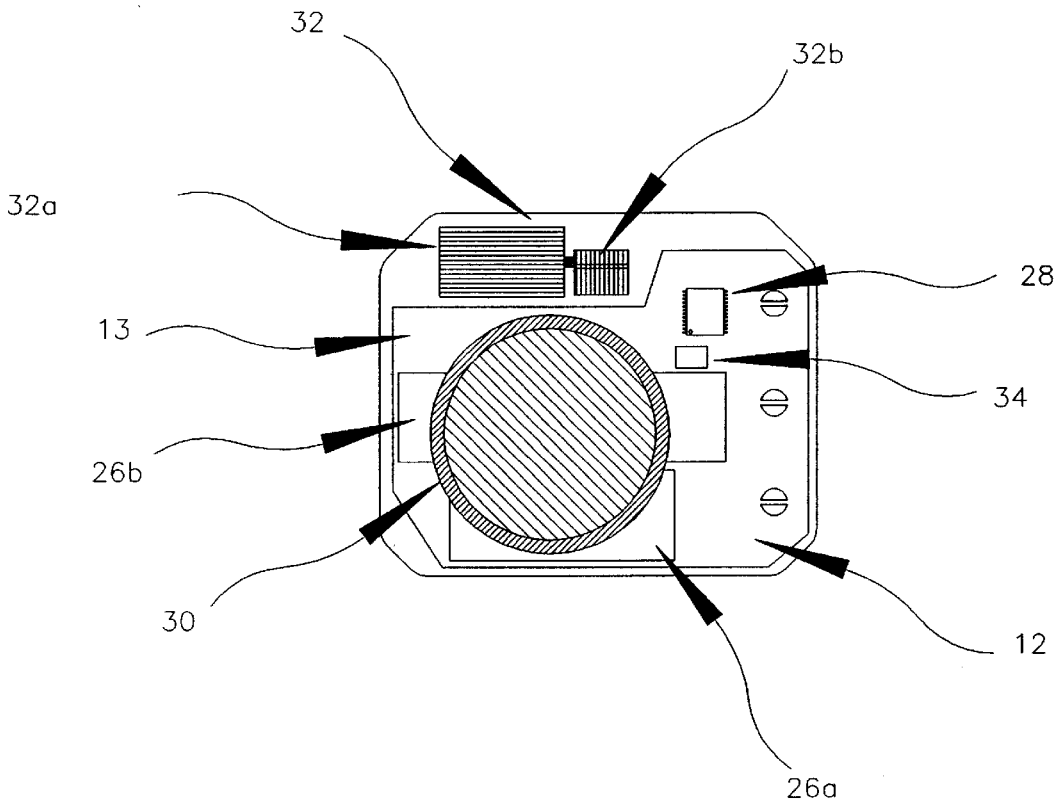
FIG. 3 is a plan view, with the cover removed, showing the principal components of the tactile reminder device of this invention.

The microprocessor 28 regulates the nature of the information being displayed by the liquid crystal display 26 and determines when the alarm 32 is operated. As depicted in FIGS. 2 and 3, the microprocessor 28 is mounted next to the liquid crystal display 26 within the case 12 on a printed circuit board 13. The microprocessor 28 receives electrical power from the battery 30, which is mounted at the bottom of case 12 on the side of the printed circuit board 13 opposite the microprocessor. This battery 30 is a standard component, such as Panasonic Part No. CR2354, and provides power to all the electrical components in the tactile reminder device 10. The microprocessor 28 receives time and date data from the clock/calendar chip 34 installed in case 12 next to display 26 on the same side of the board 13 as the microprocessor. The clock/calendar chip 34 is a common electronic part, such as, for example, Phillips Part No. PCF8583.

As illustrated in FIGS. 2 and 3, the tactile alarm 32 is also installed inside the case 12, and is electronically driven by the microprocessor 28 and the battery 30. The tactile alarm 32 includes a motor 32*a* having an unbalanced weight 32*b* attached its drive shaft. A suitable tactile alarm 32 is of the type often utilized in electronic paging devices. The tactile alarm 32 is rigidly attached near the underside of the case 12 in order to ensure that a maximum amount of vibration energy is transferred through the case 12 to the user's wrist 14 (FIG. 1).

Figure 5:
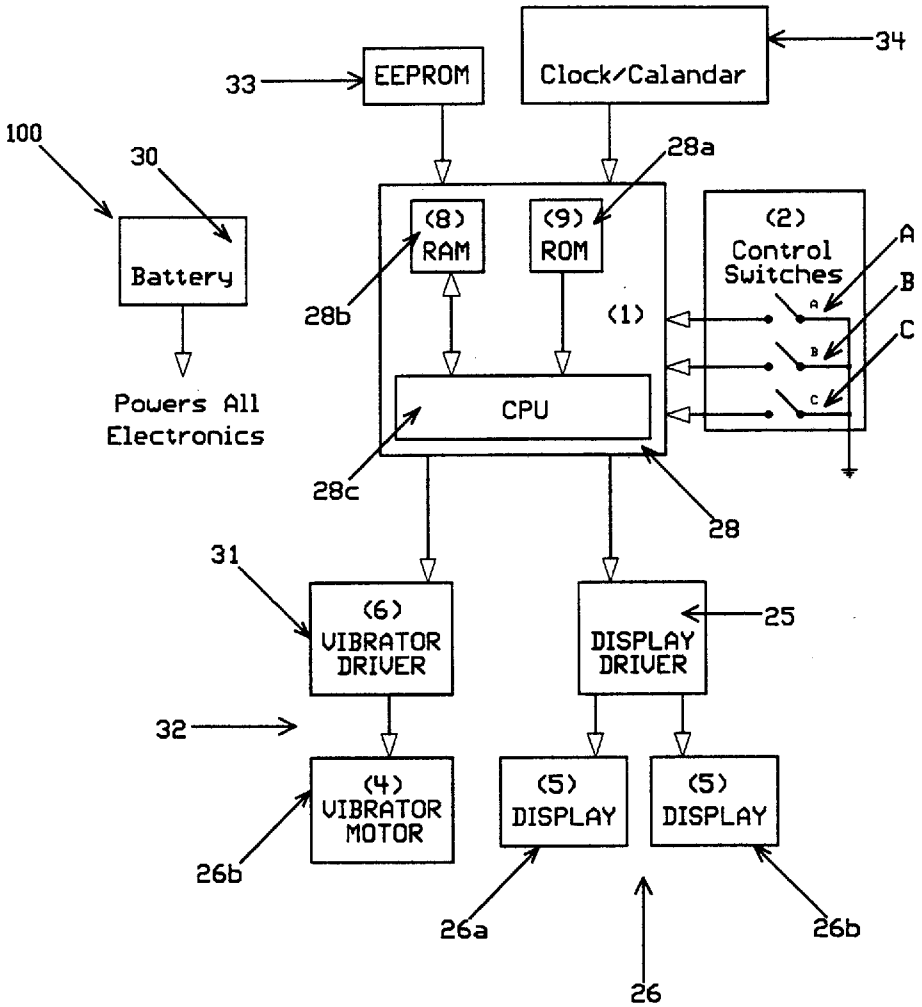
FIG. 5 is a circuit diagram showing the functional relationship of the principal components of this invention.

A circuit diagram 100 depicting the functional relationship of the principal components of the tactile reminder device 10 is illustrated in FIG. 5. The battery 30 provides electrical power to the microprocessor 28, the clock/calendar chip 34, the liquid crystal display 26, and the tactile alarm 32. The microprocessor 28 includes a Read Only Memory (ROM) 28*a*, a Random Access Memory (RAM) 28*b*, and a Central Processing Unit (CPU) 28*c*. The ROM 28*a* provides the memory which stores an application program for operating the device 10 and all the possible messages which may be displayed on the display panel 26*b*. The RAM 28*a* provides the random access memory required by the microprocessor 28 when running the application program and temporary storage for the PAY ATTENTION mode settings (frequency, start and stop times) and the REMINDER mode settings (messages and display time and date). An EEPROM 33 provides non-volatile memory for storage of all mode settings when power is removed, for example, when the battery 30 is dead or being replaced.

The microprocessor 28 receives electronic time and date data from the clock/calendar chip 34 and one of its output is coupled to a display driver 25 which drives the liquid crystal display 26. The microprocessor 28 also activates the tactile alarm 32 at pre-programmed intervals or frequency as set by the user. The microprocessor 28 provides a square wave signal to a vibrator driver 31 which has its output connected to the motor 32*a*. A conventional transistor (not shown) with associated components is used to amplify the square wave signal to increase the power level to the motor 32*a*. The display driver 25 receives from the microprocessor 28 binary coded digital signals and translates these signals into the proper format and level too operate the display 26.

The control panel 18 allows programming of the microprocessor 28 by the user 14 by means of the three pushbuttons A, B, and C. Pushing these pushbuttons A, B, and C provides logic signals to the microprocessor 28 in accordance with the application program. These logic signals are interpreted by the microprocessor 28 in accordance with the application program as commands to change modes, select and increment the interval or frequency of the notice on the display panel 26*b*, select time data (day and time), select messages from a pre-programmed list, and reset the device 10.

Figure 6:
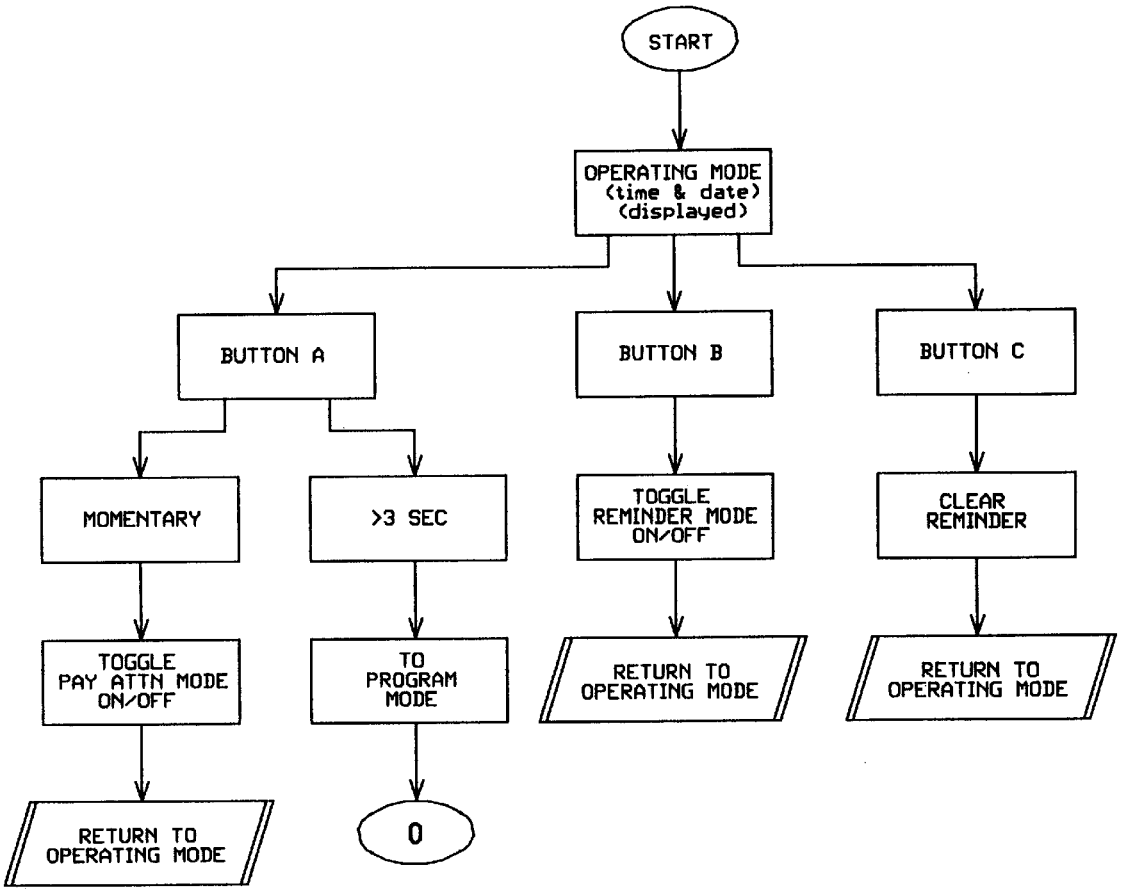
FIG. 6 is a program flow chart showing the control process in the operating mode of the three-button control embodiment of the tactile reminder device of this invention.

FIGS. 6 depicts the function of the application program in the operating mode of the tactile reminder device 10. The application program operates the microprocessor 28 to accept inputs from the control panel 18 and electronically transmit commands to the liquid crystal display 26 and tactile alarm 32 according to the process diagram illustrated in FIG. 6. In the operating mode, the liquid crystal display 26 displays the time and date and the tactile alarm 32 is inactive. Pressing pushbutton A momentarily will alternately enable and disable the PAY ATTENTION mode of the tactile reminder device 10. In this mode, the microprocessor 28 will, between the start and stop times and at intervals pre-programmed by the user 14, command the panel 26*b* to display the characters "PAY ATTN" and simultaneously activate the tactile alarm for a period of three seconds. Pressing pushbutton A for a period of 3 seconds or more will cause the tactile reminder device 10 to leave the operating mode and enter the programming mode, discussed below.

As illustrated in FIG. 6, while the tactile reminder device 10 is in the operating mode, pressing pushbutton B will alternately enable and disable the REMINDER mode of the tactile reminder device 10. In this REMINDER mode, the microprocessor 28 will, at times pre-programmed by the user 14, command the display panel 26*a* to display a message preselected by the user from a pre-programmed list of messages stored in the ROM 28*a* and simultaneously activate the tactile alarm 32 for a period of three seconds. Pressing pushbutton C will clear any message displayed on the display panel 26*a*.

FIGS. 7A through 7E depict the function of the application program in the programming mode of the tactile reminder device 10. The microprocessor 28 is pre-programmed to accept inputs from the control panel 18 and electronically transmit commands to the display 26 according to the process diagram illustrated in FIGS. 7A through 7E. In this programming mode, pressing pushbutton A momentarily will cause the tactile reminder device 10 to step to the next programming panel in the following sequence: PAY ATTENTION interval set, PAY ATTENTION start time set, PAY ATTENTION stop time set, REMINDER message selection for up to ten reminder messages, REMINDER alarm time set for each reminder message, set time, and set date.

Figure 7D:
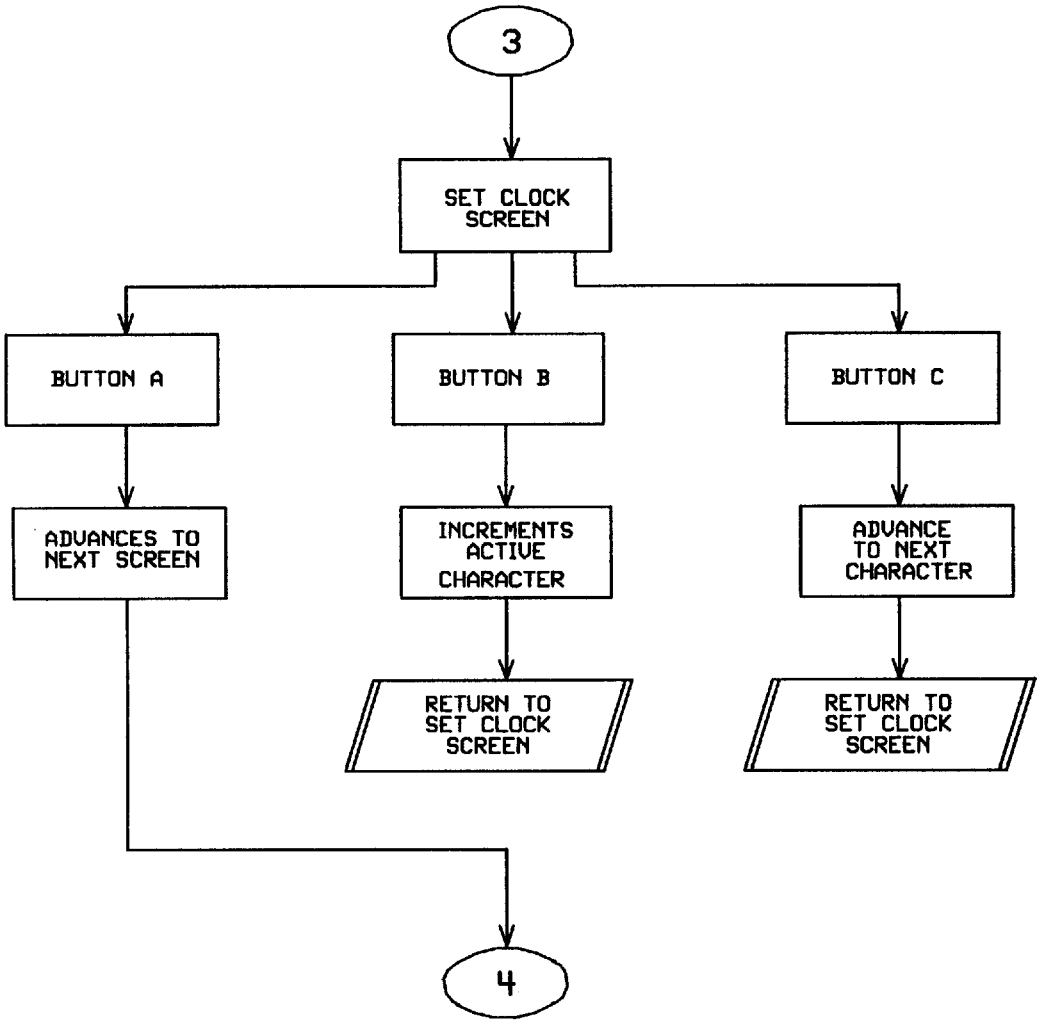
Figure 8:
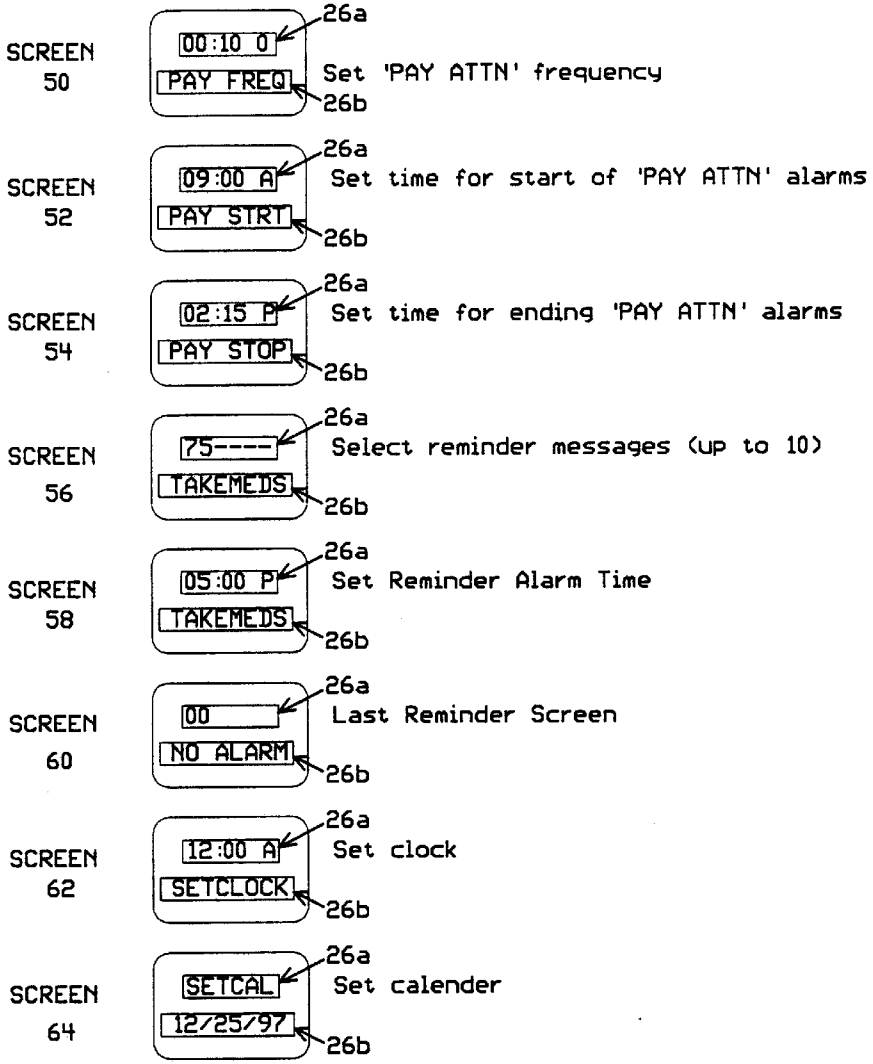
FIGS. 8 and 9 show various screens appearing on the display of the reminder device of this invention.

As illustrated in FIGS. 7A and 8, the initial screen for the programming mode is the PAY ATTENTION interval set screen 50 (FIG. 8). In this screen 50, the display panel 26*a* displays a frequency number, for example, 00:10, representing the time interval in minutes at which the notice PAY ATTN will appear in display panel 26*b*. At this time, the characters "PAY FREQ" appear in the display panel 26*b* to alert the user that the device 10 is in the programming mode. While this data is displayed, each press of pushbutton B will cause the interval time shown on liquid crystal display 26 to step through the sequence of three, five, or ten minutes. In other words, depressing the pushbutton B once causes the number "00:03" to appear in the display panel 26*a*; depressing the pushbutton B again causes the number "00:05" to appear in the display panel 26*a*; and lastly depressing the pushbutton B again one more time causes the number "00:10" to appear in the display panel 26*a*. This setting of the PAY ATTENTION interval set screen 50 determines how many minutes will elapse between the PAY ATTN message appearing in the display panel 26*b* when the device 10 is in the PAY ATTENTION mode.

Pressing pushbutton A momentarily while in the PAY ATTENTION interval set screen will bring up the PAY ATTENTION start time set screen 52, as illustrated in FIG. 8. In this screen 52, the display panel 26*a* shows the time, for example, 09:00 A, at which PAY ATTENTION mode of the tactile reminder device 10 will start functioning, with the right most digit, the character A, blinking, and the characters "PAY STRT" appearing in the display panel 26*b* to alert the user that the device 10 is in the programming mode. While this data is displayed, each press of pushbutton B will cause the blinking digit to sequence through the available numbers or characters, depending on whether the blinking digit is a number or the character A or P, indicating respectively, AM or PM. Similarly, each press of pushbutton C will cause the location of the blinking digit to move towards the left, sequentially moving through each digit of the PAY ATTENTION start time screen 52.

As illustrated in FIGS. 7B and 8, pressing pushbutton A momentarily while in the PAY ATTENTION start time set screen 52 brings up the PAY ATTENTION stop time set screen 54, as illustrated in FIG. 8. In this screen 54, the display panel 26*a* shows the time, for example 02:15 P, at which the PAY ATTENTION mode will stop functioning, with the right most digit of the time blinking, and the characters "PAY STOP" appearing on the display panel 26*b* to alert the user that the device 10 is in the programming mode. While this data is displayed, pushbutton B and pushbutton C may be used in the manner discussed above to adjust the PAY ATTENTION stop time.

As illustrated in FIGS. 7C and 8, pressing pushbutton A momentarily while in the PAY ATTENTION stop time set screen 54 will bring up the REMINDER message select screen 56, as illustrated in FIG. 6. In this screen 56, the display panel 26*a* shows a two-digit message number, for example, 75, and the characters of that particular reminder message as pre-programmed into the ROM 28*a*. While this data is displayed, pushbutton B and pushbutton C may be used in the manner discussed above to adjust the two digit message number, thereby selecting the desired REMINDER message. Changes in the message number will cause the reminder message being displayed to change to the corresponding pre-programmed messages. The device may typically employs a total of ninety-nine pre-programmed eight alpha-numeric character messages stored in the ROM 28*a*, such as, for example, "GO HOME", "WASH UP", "CLEAN RM", and "DO HMWK". Message number 00 is "NO ALARM", indicating no REMINDER message will be displayed.

As illustrated in FIGS. 7C and 8, pressing pushbutton A momentarily while in the REMINDER message select screen 56 will bring up the REMINDER alarm time set screen 58, as illustrated in FIG. 8. In this screen 58, the display panel 26*a* shows the time, for example, 05:00 P, at which the previously selected message will be displayed and tactile alarm activated for 3 seconds, with the right most digit of the time blinking, and the characters of the previously selected message, in order to alert the user that the device 10 is in the programming mode. While this data is displayed, pushbutton B and pushbutton C may be used in the manner discussed above to adjust the REMINDER message alarm time. Pressing pushbutton A momentarily while in this screen will return the user 14 to the REMINDER message select screen to repeat the above programming process for additional REMINDER messages as depicted by screen 60. Up to 10 message may be programmed into the device 10 out of the total of ninety-nine messages.

Once the user 14 has programmed the last REMINDER alarm time set 52, pressing pushbutton A momentarily will bring up the set clock screen 62, as illustrated in FIGS. 7D and 8. While this data is displayed, pushbutton B and pushbutton C may be used in the manner discussed above to adjust the time of day setting of the tactile reminder device 10. As shown in screen 62 the time is being set for 12:00 A which appears in the display panel 26*a*. While in this programming mode, the characters SET CLOCK appear in the display panel 26*b*.

Figure 7E:
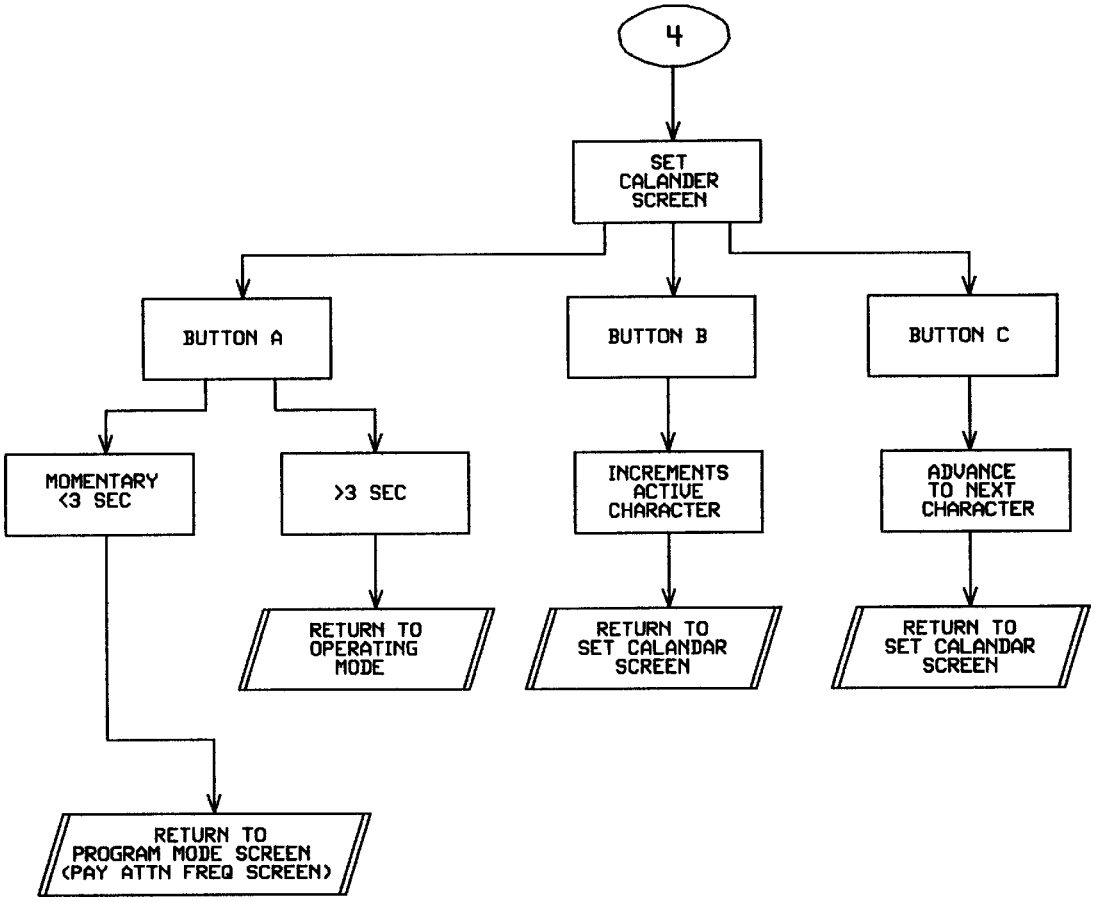

Pressing pushbutton A momentarily while in the set clock screen 62 will bring up the set calendar screen 64, as illustrated in FIGS. 7E and 8. The characters SET CAL appear in the display panel 26*a* and the month, day, and year appear in the display panel 26*b*, for example, Dec. 25, 1997. While this data is displayed, pushbutton B and pushbutton C may be used in the manner discussed above to adjust the month, day, and year setting of the tactile reminder device 10.

Pressing pushbutton A for at least three seconds while in any of the above programming mode screens will cause the tactile reminder device 10 to store all the previously updated information in microprocessor 28 and return to operating mode 36, as illustrated in FIG. 7E.

Figure 9:
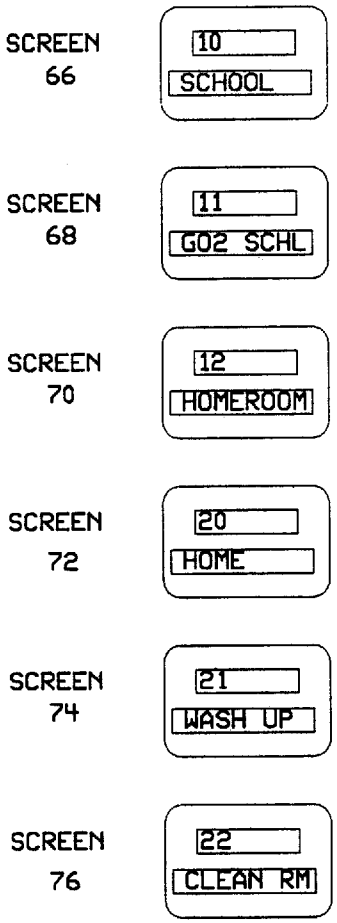

Scrolling through the ninety-nine pre-programmed reminder messages by hand to find the desired one is obviously cumbersome. One way around this is to use a written list. The message is located on the list and then the 2 digit number associated with the message appearing in the display panel 26*a* is entered via the three programming buttons A, B, and C. Another technique is to make the most significant digit correspond to a category of messages, i.e. School, Home, Medicine, etc. For example, referring to FIG. 9, the screen 66, the programmer enters the most significant digit, for example 1, for a school-related reminder, followed by a 0. The word school will appear in the display panel 26*b*. Pressing button B scrolls through the messages in this category. For example, screen 68 shows the number 11 appearing in the display panel 26*a* corresponding to the message "GO2 SCHL", an abbreviation for "GO TO SCHOOL". Similarly, screen 70 shows the number 12 appearing in the display panel 26*a* corresponding to the message "HOME ROOM". Entering other numbers for the most significant digit followed by a zero will call up other categories. Screens 72, 74, and 76 are typical for activities at home.

An additional way of simplifying the programming is to program it through another electronic device such as a personal computer via a wired interface to the device 10. A number of wireless technologies exist such as InfaRed (optical), RF or magnetic coupling through suitable transducers permit the device 10 to be conveniently programmed.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A reminder device, including a case sized so that said case is adapted to be worn on the wrist of a user, said case holding a microprocessor, a tactile alarm, an electric clock, and a battery which provides electric power to the microprocessor, the tactile alarm, and the electric clock, a display on the case which displays from time to time (a) a notice alerting the user to be attentive, and (b) one of a plurality a pre-programmed messages, said one pre-programmed message being selected by the user, and a control panel on the case which enables the user to select which of said pre-programmed message is displayed, said alarm being activated when the notice is displayed, and said alarm being activated when the pre-programmed message is displayed.

2. The reminder device of claim 1 including a control mechanism which enables the user to select a periodic interval at which said notice is displayed.

3. The reminder device of claim 1 including a control mechanism which enables the user to select the day and time at which of said pre-programmed message is displayed.

4. The reminder device of claim 1 including a control mechanism which enables the device to be switched between an operating mode and a programming mode.

5. The reminder device of claim 4 where, with said device in the programming mode, the control mechanism upon activation by the user enables the user to select (a) a periodic interval at which said notice is displayed, (b) the pre-programmed message to be displayed, and (c) the day and time at which said selected pre-programmed message is displayed.

6. The reminder device of claim 4 where, with said device in the programming mode, the control mechanism upon activation by the user selects what time period during the course of a day said notice shall be displayed at said periodic interval.

7. A reminder device, including a microprocessor, a tactile alarm which is controlled by said microprocessor, an electronic clock which provides time data to said microprocessor, a readout which displays data from the microprocessor, said readout displaying (a) a notice at periodic intervals selected by the user alerting the user to be attentive, (b) a pre-programmed reminder message selected by the user, and (c) a time and date, a battery which provides electric power to said microprocessor, said tactile alarm, said electronic clock, and said readout, and a control mechanism which enables the user to select (a) at least one of a predetermined number of said pre-programmed reminder messages to be displayed, (b) a time of day at which said pre-programmed reminder message is displayed, (c) a periodic time interval at which said notice is displayed, (d) a periodic time interval at which said tactile alarm is automatically activated concurrent with the display of said notice, and (e) a time of day at which said tactile alarm is automatically activated concurrent with the display of said message.

8. The tactile reminder device of claim 7 wherein said control mechanism includes (a) a mode control mechanism which enables the user to switch between a programming mode and a operating mode, (b) a change control member which enables the user to change a setting of said reminder message while in said programming mode, and (c) a reset control member which enables the displayed reminder message to be cleared by the user.

9. The tactile reminder device of claim 1 wherein said tactile alarm has a single fixed vibration mode.

10. A method of assisting an individual with an Attention Deficit Hyperactivity Disorder to remember daily tasks, including (a) said individual wearing a watch-like reminder device having a tactile alarm and a memory storing a predetermined number of pre-programmed messages, said tactile alarm operating at times selected by said individual to display one message selected by said individual from said predetermined number of pre-programmed messages, and (b) said individual selecting said message based on said individual's need to be reminded of tasks to perform and the time at which the tactile alarm is activated.

11. The method of claim 10 where a notice to pay attention is periodically displayed by the watch-like reminder device and the tactile alarm is concurrently activated with said notice.

12. A method of assisting an individual with an Attention Deficit Hyperactivity Disorder to pay attention, including (a) said individual wearing a watch-like reminder device having a tactile alarm, said device providing a notice to pay attention at time intervals selected by said individual, said tactile alarm operating concurrently with said display of the notice, and (b) said individual selecting the time interval at which the notice is displayed.

13. A method of assisting an individual with an Attention Deficit Hyperactivity Disorder, including (a) said individual wearing a watch-like device that (i) operates periodically at a predetermined interval to display a notice that the individual pay attention, (ii) periodically displays a message selected by said individual, (iii) operates a tactile alarm when said notice is displayed, and (iv) operates a tactile alarm when said message is displayed, and (b) said individual selecting said interval and said message.

14. The method of claim 13 where the watch-like device includes a case sized so that said case is adapted to be worn on the wrist of a user, said case holding a microprocessor, a tactile alarm, an electric clock, and a battery which provides electric power to the microprocessor, the tactile alarm, and the electric clock, a display on the case which displays from time to time (a) a notice alerting the user to be attentive, and (b) one of a plurality a pre-programmed messages, said one pre-programmed message being selected by the user, and a control panel on the case which enables the user to select which of said pre-programmed message is displayed, said alarm being activated when the notice is displayed, and said alarm being activated when the pre-programmed message is displayed.

* * * * *